US005472040A

United States Patent [19]

Brückner

[11] Patent Number: 5,472,040

[45] Date of Patent: Dec. 5, 1995

[54] CONTINUOUS CASTING MOLD WITH ADJUSTABLE WIDTH

[75] Inventor: Klaus Brückner, Haan, Germany

[73] Assignee: Mannesmann Aktiengesselschaft, Dusseldorf, Germany

[21] Appl. No.: 216,492

[22] Filed: Mar. 22, 1994

[30] Foreign Application Priority Data

Mar. 22, 1993 [DE] Germany ..... 43 09 592.5

[51] Int. Cl.[6] ..... B22D 11/04

[52] U.S. Cl. ..... 164/436; 164/491

[58] Field of Search ..... 164/436, 491, 164/418

[56] References Cited

FOREIGN PATENT DOCUMENTS 59-78756 5/1984 Japan ..... 164/436

63-2536 1/1988 Japan ..... 164/436

*Primary Examiner*—Kuang Y. Lin

*Attorney, Agent, or Firm*—Cohen, Pontani, Lieberman, Pavane

[57] ABSTRACT

A continuous casting mold includes a pair of opposed, spaced apart front and rear mold wall members and a pair of opposed, spaced apart side wall members arranged between the front and rear mold wall members. Each of the side wall members includes a pair of opposed side edges, the first side edge of the pair of edges being defined as that portion of the side wall member in contact with the adjacent front mold wall member and the other side being defined as that portion of the side wall member in contact with the adjacent rear mold wall member. Each lateral surface of the sidewall members defines a recess formed in each side edge for providing a clearance between a portion of each side edge and the adjacent mold wall member. Within each recess is disposed a linear bearing assembly which holds the front and side wall members at a predetermined distance and which absorbs clamping forces applied to the front and rear wall members.

7 Claims, 1 Drawing Sheet

(C-C)

(A-A)

(B-B)

CONTINUOUS CASTING MOLD WITH ADJUSTABLE WIDTH

BACKGROUND OF THE INVENTION

1. Field of the Invention

This invention relates generally to continuous casting molds and, more particularly, to an adjustable width continuous casting mold having narrow-side plates arranged between broadside plates that are held by clamping forces.

2. Description of the Related Art

Molds of the type heretofore used in the continuous casting of molten metal slabs are described and illustrated in numerous prior art patents such as U.S. Pat. Nos. 3,964,727 of Jun. 22, 1976, and 4,124,058 of Nov. 7, 1978. See also EP 0 107 564 A1, DE 27 02 976 C2, DE 38 38 010 A1, and DE 36 40 096 C1. Typically, continuous casting molds comprise a pair of opposed, spaced apart side walls which are adjustably clamped between opposed, spaced apart front and rear walls. The four walls are configured as a box-like container or frame having open upper and lower ends to form a casting cavity interiorly of the walls. Molten metal is poured into the open upper end of the mold and is partially cooled within the cavity as the metal flows downwardly through the cavity under the influence of gravity so as to form a solidified skin surrounding an interior core of molten metal. This skin and core together form a continuous elongated extrusion-like slab which emerges from the open lower end of the mold and is thereafter cooled to form a solid slab.

As described in the aforementioned U.S. Pat. No. 3,964,727, the mold side walls (often referred to as side wall members) are supported upon mounting blocks so that they may be adjusted inwardly toward each other or outwardly away from each other by adjusting longitudinal movement of support shafts carried by the blocks. The mounting blocks also are provided with bolts to support the blocks to the front and rear walls of the mold, and plungers or separators to separate the mold walls against a spring pressure to thus loosen the side wall members for adjustment when desired. Thus, during adjustment of the widths of the conventional molds as described above, the front and rear walls of the mold are held sufficiently apart to unclamp the side wall members so that the side wall members may be adjusted inwardly or outwardly to change the width of the metal slab.

One disadvantage associated with the prior art configurations described above, however, is that when the narrow-side plates are adjusted to a determined slab width and, at a given casting speed, to a determined conicity or amount of taper, unforeseeable thermal changes in the length of the broadside plates may occur as a result of fluctuations in the production sequence. These thermal changes may, for example, include a change in the melt temperature or a change in the cooling conditions in the mold.

The effects of thermal changes is particularly pronounced at the beginning of casting, that is, when filling the mold, since the temperatures occurring in the upper mold region are higher than those at the mold output because of the higher thermal loading. Since the broadside plates and narrow-side plates are arranged within a rigid mold frame, the thermal change in the length of the broadside plates leads to a displacement of the narrow-side plates so that the adjusted amount of taper of the narrow-side plates is changed. If the forces brought about by the thermal change in length exceed the contact pressure forces, the displacement of the narrow-side plates in proportion to the broadside plates can result in wear at the copper plates of the broadside plates. In any event, the results will be undesirable for continuous casting.

It has been proposed to counteract the problem of thermal changes in nonadjustable width molds by arranging inserts between the broadside plates and the edge regions of the contacting narrow-side plates, which inserts extend over the height of the mold. For an illustrative example of such a configuration, reference may be made to Published Specification DAS 19 39 777. Heretofore, however, it has not been possible to account for thermal changes in an adjustable width mold whereby the amount of taper of the narrow-side plates, once adjusted, is maintained during casting.

It is therefore an object of the present invention to provide an adjustable width continuous casting mold which avoids the disadvantages described above and in which the amount of taper of the narrow-side plates, once adjusted, is maintained during casting even under altered operating conditions and which prevents damage to the broadside plates.

SUMMARY OF THE INVENTION

The aforementioned objects, as well as others which will become apparent to those skilled in the art, are achieved by a continuous casting mold in which narrow-side plates or side wall members are arranged between broadside plates or front and rear wall members and held by means of clamping forces applied to the broadside plates via tie rods. The side wall members have a face plate defining surfaces of the mold cavity at the narrow sides and an end plate support or backing plate. The side wall members are adjustable toward or away from one another to achieve a desired billet size via a connecting arm and an actuating device.

Recesses are incorporated into the upper and lower region in the side faces of the backing plate opposite the front and rear side wall surfaces. Into the recesses, linear bearings are inserted such that they hold the front and rear wall members at a distance and absorb the clamping forces applied thereto.

In accordance with a preferred embodiment, each linear bearing has a pressure plate member fastened within the recess and a pressure lid member which is shorter in the movement direction of the front and rear wall members than the length of the recess in this direction. The remaining intermediate space is filled with an elastomer, and rolling bodies are arranged between the pressure plate and the pressure lid member. Preferably, the rolling bodies are formed by cylindrical rollers whose axes lie vertically to the adjusting direction of the side wall members. Moreover, the surface of the pressure lid member is preferably dimensioned in such a way that the pressure transmitted by the broadside clamping per unit of surface area is lower than the compressive strength of the front and rear walls.

The various features of novelty which characterize the invention are pointed out with particularity in the claims annexed to and forming a part of the disclosure.

BRIEF DESCRIPTION OF THE DRAWINGS

For a better understanding of the invention, its operating advantages, and specific objects attained by its use, reference should be had to the descriptive matter in which there are described preferred embodiments of the invention and to the accompanying drawings, in which.

DETAILED DESCRIPTION OF THE PREFERRED EMBODIMENTS

Figure 4:
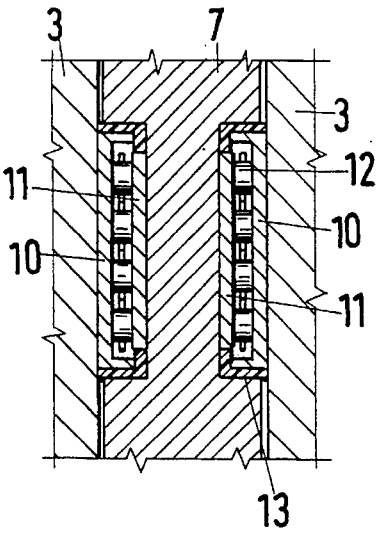
FIG. 4 is an enlarged side view taken across line C—C of FIG. 2.

An illustrative embodiment of an adjustable width, continuous casting mold constructed in accordance with the present invention is depicted in FIGS. 1–4, in which FIGS. like parts are identified by the same reference numerals.

Figure 2:
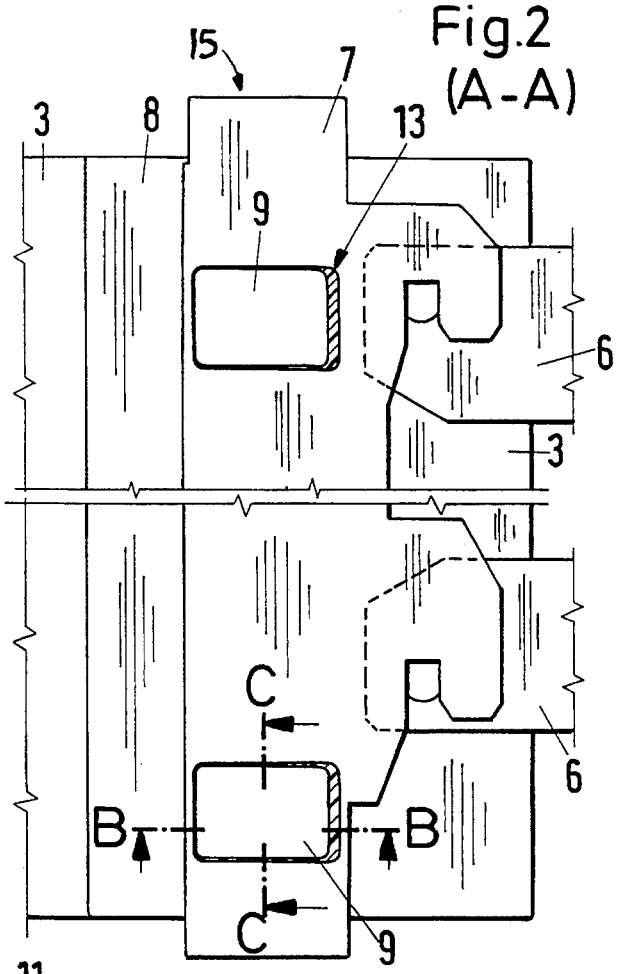
FIG. 2 illustrates an enlarged partial section view of a narrow-side plate taken across line A—A of FIG. 1.
Figure 1:
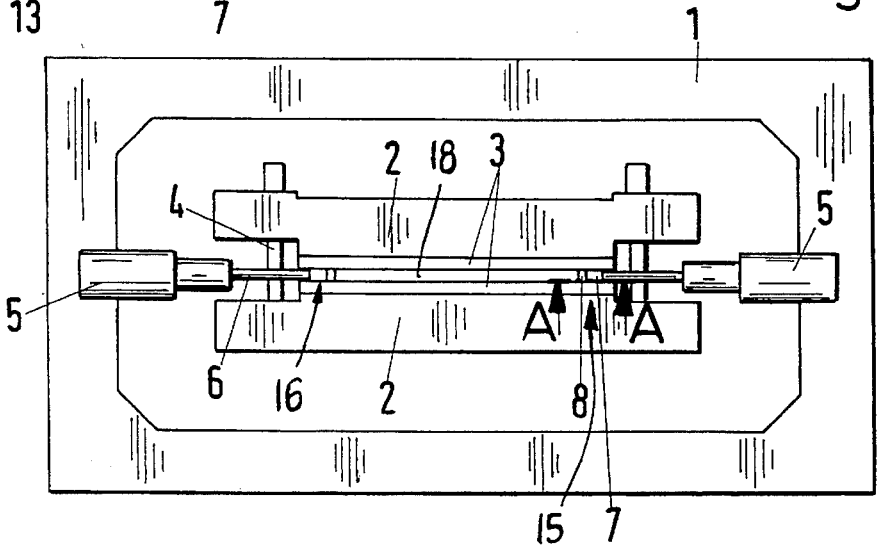
FIG. 1 depicts a plan view of an adjustable width, continuous casting mold constructed in accordance with the present invention.

With initial reference to FIGS. 1 and 2, there is shown a continuous casting mold constructed in accordance with the present invention. The continuous casting mold of the present invention is similar to the continuous casting mold described and illustrated in U.S. Pat. Nos. 3,964,727 of Jun. 22, 1976 and 4,124,058 of Nov. 7, 1978, the disclosures of which patents are hereby incorporated by reference. The continuous casting mold comprises opposed, spaced apart front and rear walls 3 and a pair of opposed, spaced apart improved side wall members 15 and 16 of the present invention.

As will be readily apparent to those skilled in the art, the four walls are configured as a rectangular box-like container open at the top and bottom and the side walls are clamped between the front and rear walls to define a casting cavity 18 therebetween which is approximately rectangular in cross-section. Molten metal is poured into the open upper end of the cavity and solidified metal in the form of a rectangular shaped slab having a solidified skin enclosing a molten metal core emerges from the open lower end of the mold cavity.

In a conventional manner, front and rear mold walls 3 are formed as a laminate structure including a copper or copper-like face plate mounted upon a steel jacket or steel backing plate. Each of the side wall members 15, 16 is also a laminate structure formed of an interior copper or copper-like face plate 8 secured to a steel jacket or steel backing plate 7. Since the copper face plates face the mold cavity 18, the copper face plates are often referred to as the interior face plates of the mold and the steel jackets or backing plates are often referred to as the exterior mold plates. Each of the interior face plates is secured to its respective steel jacket or backing plate in a conventional manner as described in the aforementioned patents.

Cooling means 2 is provided between each interior face plate and its respective backing plate for cooling the face plate and extracting heat from the metal being cast thus facilitating formation of the solidified metal skin while the molten metal is within the casting cavity. Any suitable cooling means may be utilized for this purpose. By way of example, each of the interior face plates may be provided with a series of parallel, vertically arranged, spaced-apart channels and each of the steel jackets or backing plates may be provided with horizontally arranged upper and lower pockets or depressions which act as headers. Conduits extending through each of the steel jackets may be provided to permit entry of a cooling fluid medium such as water into a lower header, through the channels or grooves, through the upper header and thereafter out of the side wall member. Such a cooling structure may be provided for each of the four mold walls.

It is conventional, with adjustable width continuous casting molds, to provide releasable means to clamp the side wall members between the opposed front and rear wall members. The releasable clamping means includes means for controlling the movement of each of side wall members 15 and 16 toward and away from each other to decrease or increase, respectively, the width of the continuous casting cavity. Suitable clamping and adjusting means are disclosed, for example, in the aforementioned United States Patents and, in the illustrative embodiment disclosed herein, include first and second actuating devices 5, 5 detachably connected to a corresponding backing plate 7 by a suitable connector or coupling means as 6. The clamping force is applied via spring-loaded tie rods 4 which connect the front and rear mold walls 3. The actuator devices 5 themselves are secured in a conventional manner to the supporting frame 1.

As heretofore described, when it is desired to adjust the position and amount of taper of the side wall plate members 15 and 16, and thus the dimensions of the continuous casting mold cavity, the actuating device is actuated to release the clamping force on the side wall members and the side wall members 15 and 16 are thereafter moved toward or away from each other.

In accordance with the present invention, linear bearings 9 are provided between each side of the backing plate and corresponding interior surfaces of the front and rear walls 3, 3. As shown in FIGS. 2 and 4, the illustrative embodiment of the present invention includes a pair of linear bearings 9 on each side of the backing plate 7, one bearing of each pair being arranged in the upper and lower face regions of backing plate 7, respectively. As best seen in FIG. 4, the outer surface of each bearing 9 projects slightly from the lateral surface of backing plate 7, and the lateral surfaces of backing plate 7 form narrow gaps with front and rear wall members 3 so that the clamping forces applied to side wall members 15 and 16 via tie rods 4 are absorbed only by the linear bearings 9. Moreover, the linear bearings 9, in combination with backing plates 7, hold the front and rear wall members at a distance.

As will be readily ascertained by those skilled in the art, the side faces of the face plates 8 contact the front and rear wall members 3 without pressure during casting and retain their defined position determined by the actuator 5, even when the front and rear wall members undergo changes in length due to thermal loading.

Figure 3:
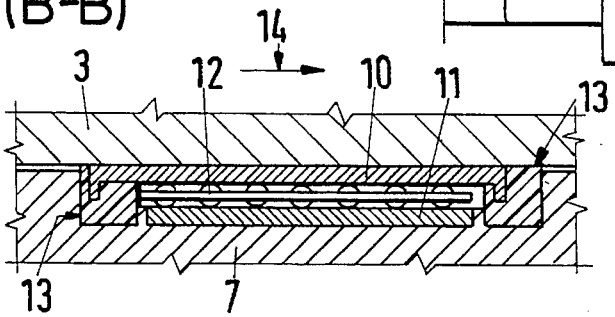
FIG. 3 shows an enlarged partial section view taken across line B—B of FIG. 2.

With particular reference to FIGS. 3 and 4, the construction of the linear bearings 9 will now be described in detail. As seen in the FIGS., the linear bearings 9 are inserted in recesses in the side faces of backing plates 7. Each linear bearing includes a pressure plate 11 set in the recess, a pressure lid member 10 which projects outside the recess beyond the plane defined by the corresponding side face surface of backing plate 7, surface, and a plurality of cylindrical rollers 12 arranged in a cage between the pressure plate 11 and pressure lid member 10. As best seen in FIG. 3, the cylindrical rollers are arranged in such a way that their axes extend vertically relative to the movement direction 14 of the front and rear wall members 3 or relative to the adjusting direction of the side wall members 15 and 16.

With particular reference to FIG. 3, it will be observed that in the movement direction 14, the pressure lid member 10 is shorter than the length of the recess receiving the linear bearing 9. The intervening space between the lateral edge surfaces of lid member 10 and the lateral interior surfaces of the recess is filled with an elastomer 13. The purpose of elastomer 13 is twofold. First, it protects the cylindrical rollers and bearing surfaces against dirt, and second, it ensures the freedom of movement of the pressure lid member 10 relative to the pressure plate 11. As such, elastomer 13 accommodates the possibility of movement of the side wall members 15 and 16 relative to the front and rear wall members 3. Furthermore, the pressure lid member 10 is dimensioned, i.e., surface area, so that pressure transmitted by clamping forces applied from the pressure lid 10 to the front and rear wall members 3, per unit of surface area, is lower than the compressive strength of the from and rear wall members 3.

The invention thus obviates the costly hydraulic regulating means which would otherwise be required. The front and rear wall members can move past or along the adjustable side wall members without interference and without affecting the adjustment of side wall member taper, regardless of the contact pressure.

The foregoing is a complete description of a preferred embodiment of the present invention. It will, of course, be understood that various changes may be made without departing from the spirit and scope of the present invention. Accordingly, the invention, therefore, should be limited only by the following claims.

What is claimed is:

1. A continuous casting mold comprising:

a pair of opposed, spaced apart front and rear mold wall members;

a pair of opposed, spaced apart side wall members arranged between said front and rear mold wall members, each of said side wall members having a pair of opposed side edges, the first side edge of the pair of edges being defined as that portion of the side wall member in contact with the adjacent front mold wall member and the other side being defined as that portion of the side wall member in contact with the adjacent rear mold wall member, and each lateral surface of each of said sidewall members defining a recess for providing a clearance between a portion of each side edge and the adjacent mold wall member; and bearing means disposed in said recesses for holding said front and rear wall members at a distance and for absorbing clamping forces applied to said front and side wall members.

2. The continuous casting mold according to claim 1, wherein each of said bearing means comprises a linear bearing having a pressure plate secured to said side wall member within a corresponding recess, a pressure lid shorter in a front and rear wall member direction of movement than said corresponding recess, rolling bodies arranged between said pressure plate and said pressure lid, and an elastomer disposed between respective lateral edges of said pressure lid and sidewalls of said corresponding recess.

3. The continuous casting mold according to claim 2, wherein said rolling bodies are formed by cylindrical rollers whose axes lie vertically relative to an adjusting direction of the side wall members.

4. The continuous casting mold according to claim 2, wherein the surface of said pressure lid is dimensioned and arranged so that pressure transmitted by clamping forces applied from said pressure lid to said front and rear wall members per unit of surface area is lower than the compressive strength of said front and rear wall members.

5. The continuous-casting mold according to claim 1, wherein each of said sidewall members includes a backing plate and a face plate, said recesses being formed in lateral surfaces of said backing plate and lateral surfaces of said face plate contacting respective surfaces of said front and rear wall members.

6. The continuous casting mold according to claim 1, wherein each lateral surface of said side wall members defines an upper and lower recess, a respective bearing means being disposed within each of said recesses.

7. The continuous casting mold according to claim 1, wherein each of said bearing means comprises a linear bearing having a pressure plate secured to said side wall member within a corresponding recess, a pressure lid member, and a plurality of rolling bodies disposed therebetween.

* * * * *